US006402144B1

(12) United States Patent
Ekberg

(10) Patent No.: US 6,402,144 B1
(45) Date of Patent: Jun. 11, 2002

(54) EDUCATIONAL CARD GAME AND METHOD

(76) Inventor: Roy V. Ekberg, 2111 E. Santa Fe, No. 346, Olathe, KS (US) 66062

( * ) Notice: Subject to any disclaimer, the term of this patent is extended or adjusted under 35 U.S.C. 154(b) by 0 days.

(21) Appl. No.: 09/576,055

(22) Filed: May 23, 2000

Related U.S. Application Data

(63) Continuation-in-part of application No. 09/404,447, filed on Sep. 22, 1999, now Pat. No. 6,109,609.

(51) Int. Cl.[7] ..... A63F 3/00

(52) U.S. Cl. ..... 273/239; 273/292; 273/296; 273/287

(58) Field of Search ..... 273/236, 273, 273/287, 153 R, 156, 157 R, 440, 443, 456, 239, 292, 296

(56) References Cited

U.S. PATENT DOCUMENTS 3,662,477 A * 5/1972 Weinstein
3,680,865 A * 8/1972 Davis
3,765,679 A * 10/1973 O'Connell
3,909,003 A * 9/1975 Rabinovich
4,838,551 A * 6/1989 Volpert
4,952,153 A * 8/1990 McAllister
5,037,106 A * 8/1991 Jodway
5,120,226 A * 6/1992 Tsai
5,626,477 A * 5/1997 Adkison
5,752,701 A * 5/1998 Kao

FOREIGN PATENT DOCUMENTS

GB 2196542 A * 5/1988

* cited by examiner

*Primary Examiner*—Benjamin H. Layno
*Assistant Examiner*—V K Mendiratta
(74) *Attorney, Agent, or Firm*—Dale J. Ream

(57) ABSTRACT

An educational card game and method for play comprises a plurality of cards with each card having a surface with indicia imprinted thereon. Each card further includes a metallic element embedded beneath the card surface The card game further includes a game board having a plurality of disk magnets mounted between opposing surfaces such that the cards may be selectably positioned on the game board to display a desired sequence of the indicia. The disk magnets are configured such that an imprecisely positioned card will be magnetically drawn to a predetermined position on the game board by the magnetic attraction between a respective magnet and metallic element.

15 Claims, 9 Drawing Sheets

FIG. 3b
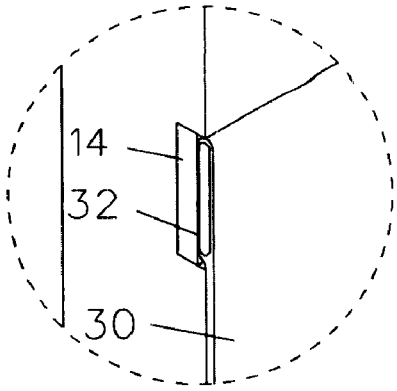
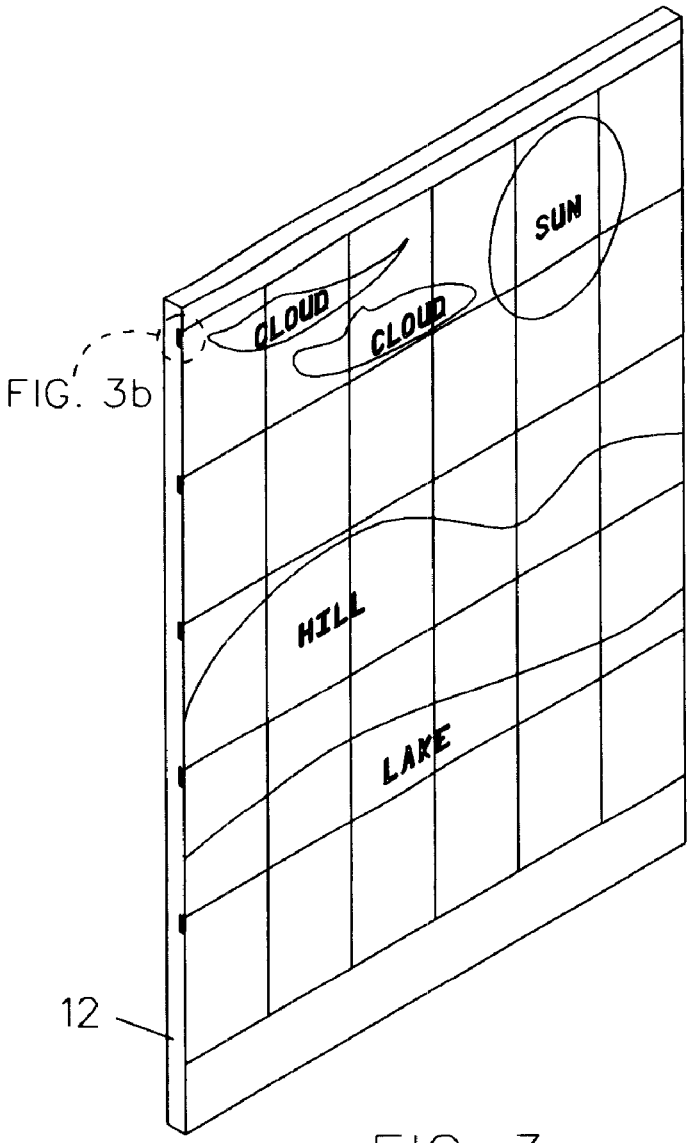
FIG. 3a

EDUCATIONAL CARD GAME AND METHOD

CROSS-REFERENCE TO RELATED APPLICATIONS

This application is a continuation-in-part of application Ser. No. 09/404,447, filed Sep. 22, 1999 now U.S. Pat. No. 6,109,609.

BACKGROUND OF THE INVENTION

This invention relates generally to a learning game and, more particularly, to a board game in which cards bearing alphabetic, numeric, or other indicia are releasably positioned on the game board according to a method for learning through association.

A child can learn the alphabet, numbers, colors, and other elements of sets by associating the elements with previously learned elements or simply by matching an element with an identical element. The limited attention span of a small child, however, often provides a hurdle to learning in this manner. It is recognized that some form of entertainment coupled with an educational process is highly beneficial to the learning process. Hence, the term "edutainment" may be appropriately applied to this scenario.

Various card games have been proposed as learning aids. However, known card games for teaching the alphabet or numerals through association either require a user to hold several cards at once (often irregularly shaped cards) or to place them on a flat surface where their placement can be inadvertently disrupted. Such games, therefore, do not provide a convenient means for selectively placing cards on a game board that securely holds the cards during game play yet allows convenient removal or repositioning as desired. Further, the limited dexterity of a young child can make it difficult to precisely position puzzle pieces on a game board.

Therefore, it is desirable to have a game in which cards can be held securely to a game board during game play, whether the board is oriented horizontally, vertically, or at some angle therebetween. Further, it is desirable to have a game in which either side of each card may be displayed while being retained on the game board. Also, a game is desired which includes a set of cards having alphabetic, numeric, color, or other indicia on one or both sides of each card. It is also desirable to have a game board which magnetically assists a young child in precisely positioning a puzzle piece or card.

SUMMARY OF THE INVENTION

Accordingly, the educational game and method for playing according to the present invention includes a plurality of cards having indicia imprinted on a side thereof and having a raised flange extending across a top edge. The game further includes a game board having a channel formed therein for releasably retaining each raised flange therein. The channel includes a magnetic strip and the retaining flange includes a metallic element which detachably adheres to the magnetic strip. Thus, the raised flange of a card mates with the channel for positioning a card on the game board and is held securely thereon by the magnetic attraction between the magnetic strip and metallic element.

The indicia imprinted on the cards and game board may be letters of the alphabet, numerals, or portions of a pictorial scene. Multiple sets of differently colored cards having the same type of indicia may be combined into a single deck of cards for game play with a particular color of cards being "playable." Points are awarded as players properly position cards on the game board. Recognition, matching, and association of the various types of indicia provide an entertaining and effective form of education.

Alternatively, the game board may include a plurality of disk-shaped magnets strategically positioned therein in spaced apart relationship and each card of a set of cards may include a metallic element therein. Accordingly, each card is accurately positioned upon the game board by the magnetic attraction between a respective magnet and a respective metallic element. Even if a card is not precisely positioned at first, the attraction of a respective magnet will draw the card to a more precise position. This configuration also provides for holding adjacent cards in a tight, mating relationship when all of the cards have been placed on the game board.

Therefore, a general object of this invention is to provide a game which aids learning through association of elements within a category or set.

Another object of this invention is to provide a game, as aforesaid, having at least one deck of cards individually imprinted with alphabetic, numeric, color, or similar indicia.

Still another object of this invention is to provide a game, as aforesaid, in which individual cards may be selectively positioned and retained on a game board during game play.

A further object of this invention is to provide a game, as aforesaid, in which individual cards may be magnetically moved into a predetermined position even when the cards are not at first precisely positioned by a game player.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 3*a* is a front view of a game board with a set of cards retained thereon according to an alternative embodiment of the invention;

FIG. 3*b* is an isolated view on an enlarged scale of a retention means of a respective card in cooperation with the game board as in FIG. 3*a;*

FIG. 7*b* is an isolated cut-away view on an enlarged scale of a metallic element and magnet as in FIG. 7*a;*

FIG. 9*b* is an isolated cut-away view on an enlarged scale showing the placement and configuration of magnets as in FIG. 9*a*.

DESCRIPTION OF THE PREFERRED EMBODIMENT

Figures 1A, 1B:
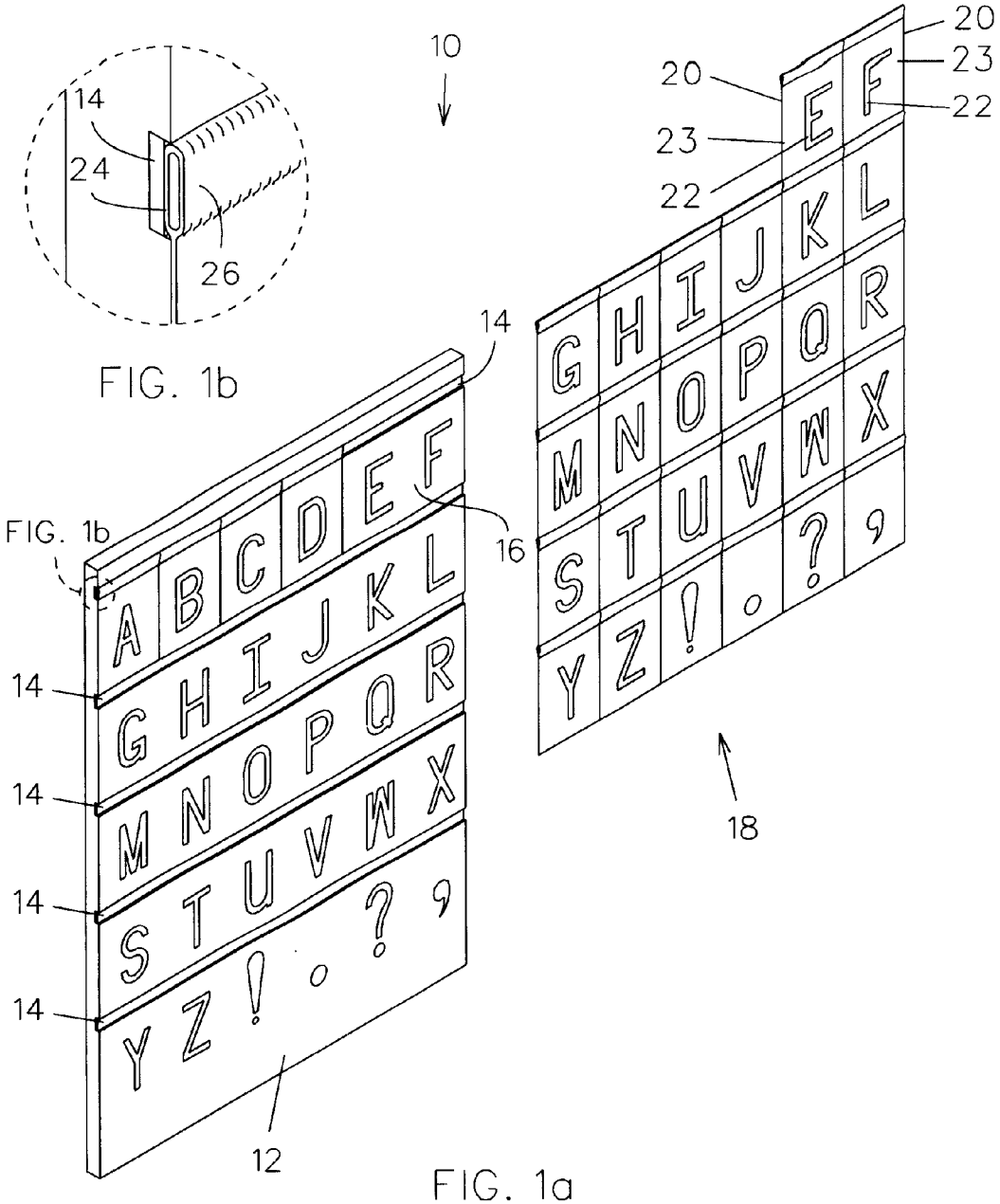
FIG. 1*a* is a front perspective view of a game board with a set of cards retained thereon such that respective first sides of the cards are visible.
FIG. 1*b* is an isolated view on an enlarged scale of a retention means of a respective card in cooperation with the game board as in FIG. 1*a;*
Figure 2:
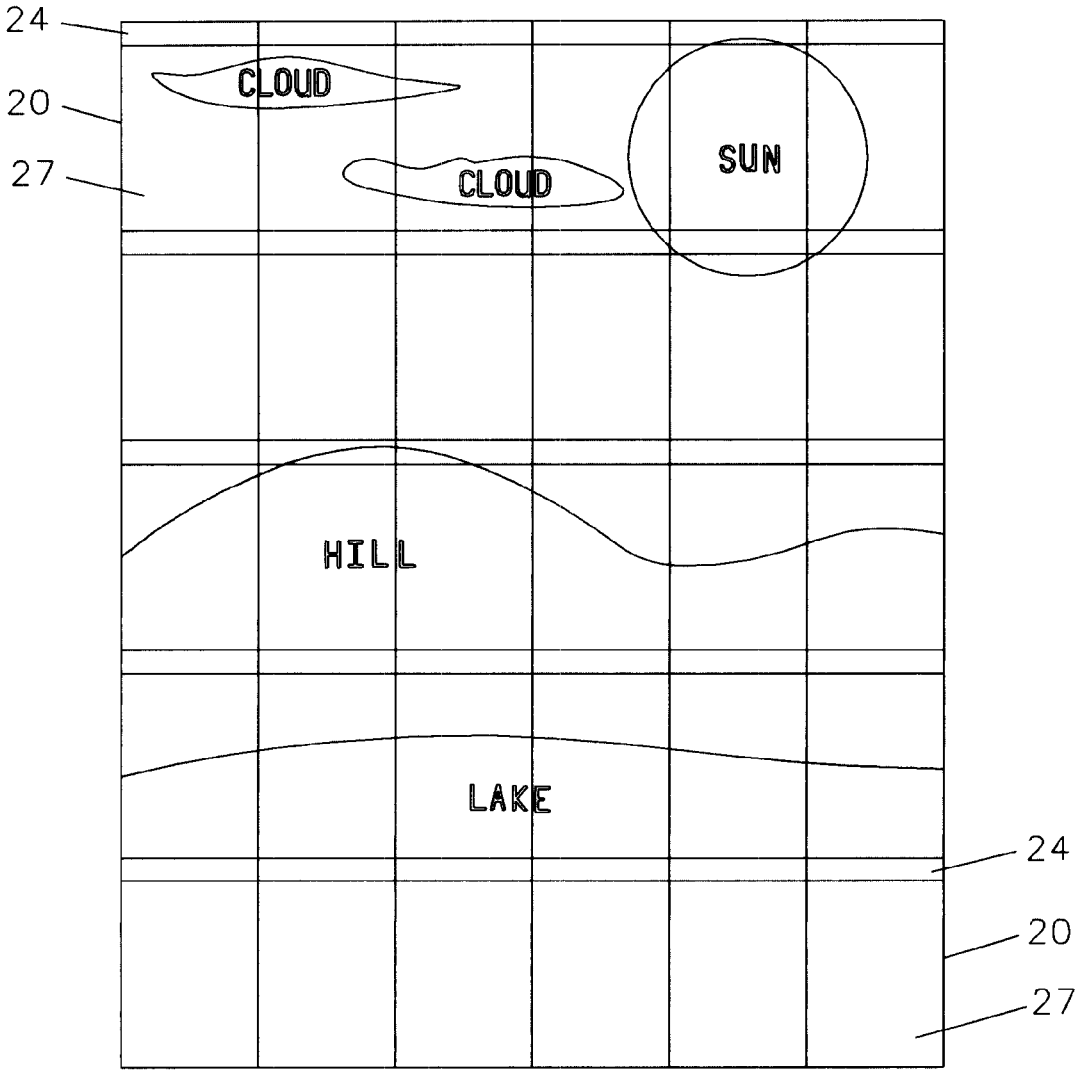
FIG. 2 is a front view of the game board as in FIG. 1 with the cards configured such that respective second sides of the cards are visible.

Turning now more particularly to the drawings, FIGS. 1*a* through 2 show an educational card game 10 according to the present invention. The card game 10 includes a game board 12 having a generally flat support surface constructed of cardboard although plastic, metal, or fibrous materials would also be suitable. The game board 12 can be held by a user or placed flat against a horizontal or vertical surface. A series of spaced apart elongate channels 14 form a retention structure and extend laterally across the game board 12 and are parallel to one another (FIGS. 1*a* and 1*b*). It is understood that the channels 14 can alternatively extend vertically or diagonally across the game board 12 to accommodate various other card games. A magnetic strip extends across the game board within each channel 14.

The game board 12 further includes a series of indicia 16 imprinted along the channels 14. While letters of the alphabet are imprinted on the game board 12 according to the preferred embodiment of the game, other types of indicia could alternatively be utilized, such as numerals or pictures. Also, the back side of the game board 12 may have a construction substantially similar to that of the front side (not shown) and include indicia different than the indicia on the front side such that two different card games may be played using a single game board. The indicia 16 are imprinted in traditional logical sequence, such as alphabetical or numerical order or as necessary to form a picture, as appropriate.

The card game 10 further includes a plurality of game tiles such as at least one set of cards 18 for use in game play. If multiple sets of cards are provided, each set is formed of card stock of a different color. Multiple sets of cards may be combined into a single deck of cards for game play, as to be more fully described below. Each set of cards 18 includes a plurality of individual cards 20 having a set of indicia 22 represented individually on respective first sides 23 thereof. For example, the set of cards 18 may include a plurality of cards with each card having a different letter of the alphabet imprinted thereon (FIG. 1*a*).

Each card 20 includes a first raised flange 24 extending across a top edge thereof. The first raised flange 24 presents a configuration complementary to the configuration of each channel 14 so as to removably mate therewith. The first raised flange 24 is constructed of a metal that magnetically adheres to the magnetic strip within each channel 14. Alternatively, a magnetic material may be included in the railed flange 24 and a metallic strip within each channel 14. As shown in FIG. 1*a*, each card 20 having a letter of the alphabet imprinted thereon is positioned over a corresponding letter of the alphabet imprinted on the game board 12. Each card 20 further includes a second raised flange 26 extending across the top edge thereof opposite the first raised flange 24. The second raised flange 26 is configured to mate with the channels 14 as previously described. Each card 20 also includes indicia individually represented on respective second sides 27, the indicia being portions of a pictorial scene. When all of the cards are correctly positioned according to the corresponding indicia on the game board 12 and first sides 23 of the cards, a complete pictorial scene is displayed by flipping each card over to reveal the respective second sides 27 (FIG. 2).

An alternative embodiment of the game 28 is shown in FIGS. 3*a* and 3*b* in which each card 30 in a set of cards includes only a single raised flange 32 configured to mate with the channels 14 of the game board 12. Each card 30 includes indicia imprinted on one side thereof. This embodiment is particularly advantageous for positioning cards which reveal a pictorial scene in that a second raised flange does not interrupt the continuity of the scene.

Figure 4:
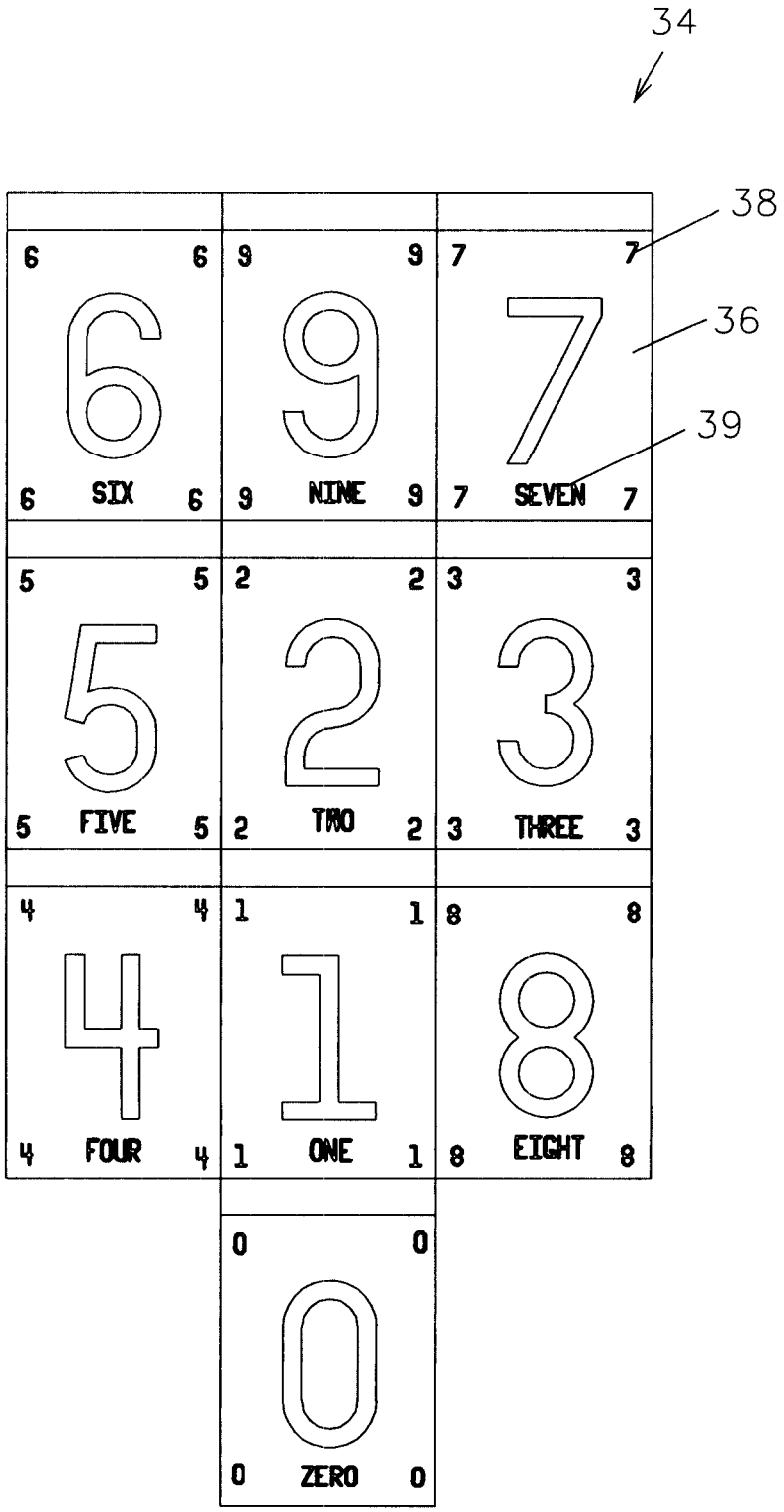
FIG. 4 is front side of a set of cards having numeric indicia on one side thereof.

Referring now to FIG. 4, numeric indicia may be individually represented on cards 36 of another card set 34. The numeric indicia may be imprinted in both number form 38 and word form 39 so as to enhance learning by association. The cards 36 of the numeric card set 34 include raised flanges configured to adhere to the game board as previously described and can be positioned randomly or in logical sequence as desired by a game player. It is understood that pictorial indicia can also be included on the reverse sides of the cards 36 so as to verify correct positioning.

Figure 5:
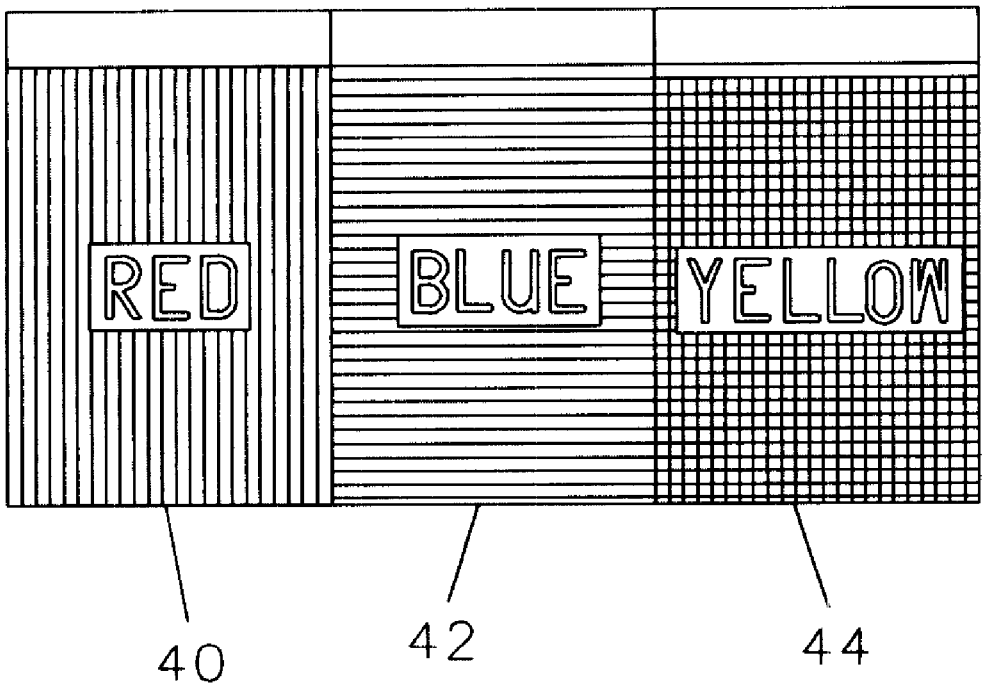
FIG. 5 is a front view of a set of cards having color indicia thereon.

The card game includes multiple card sets 40, 42, 44 having the same type of indicia imprinted thereon. The sets, however, are each characterized by a different color as shown in FIG. 5. For example, differently colored sets of cards having alphabetic indicia imprinted thereon may be combined into a single deck of cards during game play as described below.

In use, a selected number of differently colored card sets having a common type of indicia thereon are combined into a single deck of cards and shuffled (e.g. each set includes alphabetic characters). A predetermined number of cards is then dealt to each of a desired number of game players. Cards having a particular color may be designated as "playable". In succession, each user is given opportunity to position one or more cards on the game board with points being scored as agreed upon by the players. If a player does not have a "playable" card, the player must draw a predetermined number of additional cards from the deck. The player also draws additional cards according to the number of cards played. The next player in succession repeats these steps. According to the preferred embodiment, positioning a card on the game board involves superimposing a card having a particular marking over a corresponding marking on the game board 12 (e.g. matching alphabetic characters). When all playable cards have been positioned, the winner is declared to be the player who accumulated the most points. It is understood that this game can be played by a single player, such as by a child who is learning the correct logical sequence of the alphabet or numbers. When all of the cards have been positioned, the cards may be flipped over to reveal a pictorial scene which verifies the accuracy of original card placements.

Figure 6B:
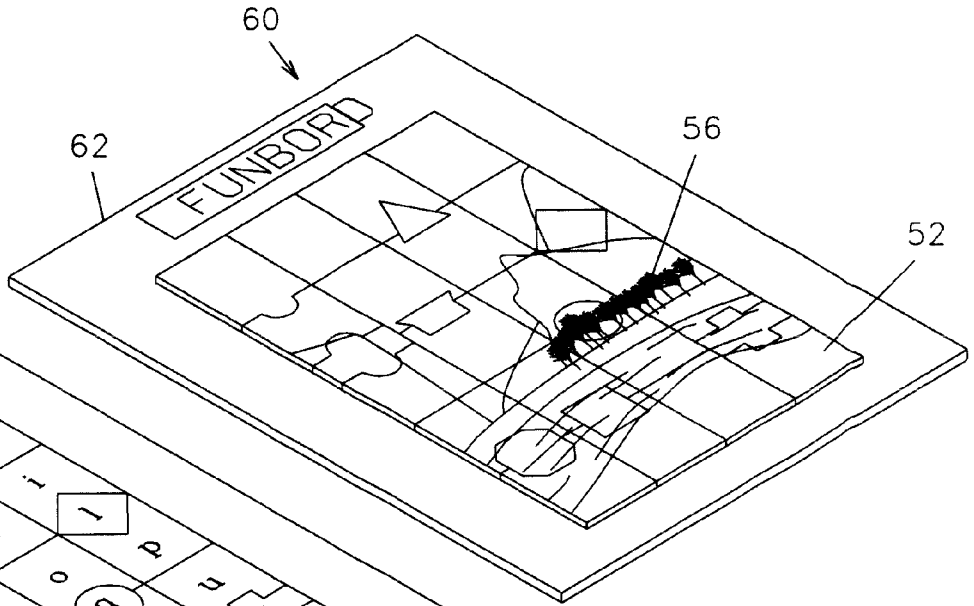
FIG. 6*b* is a perspective view of the alternative embodiment as in FIG. 6*a* such that respective second sides of said cards are visible.
Figure 6A:
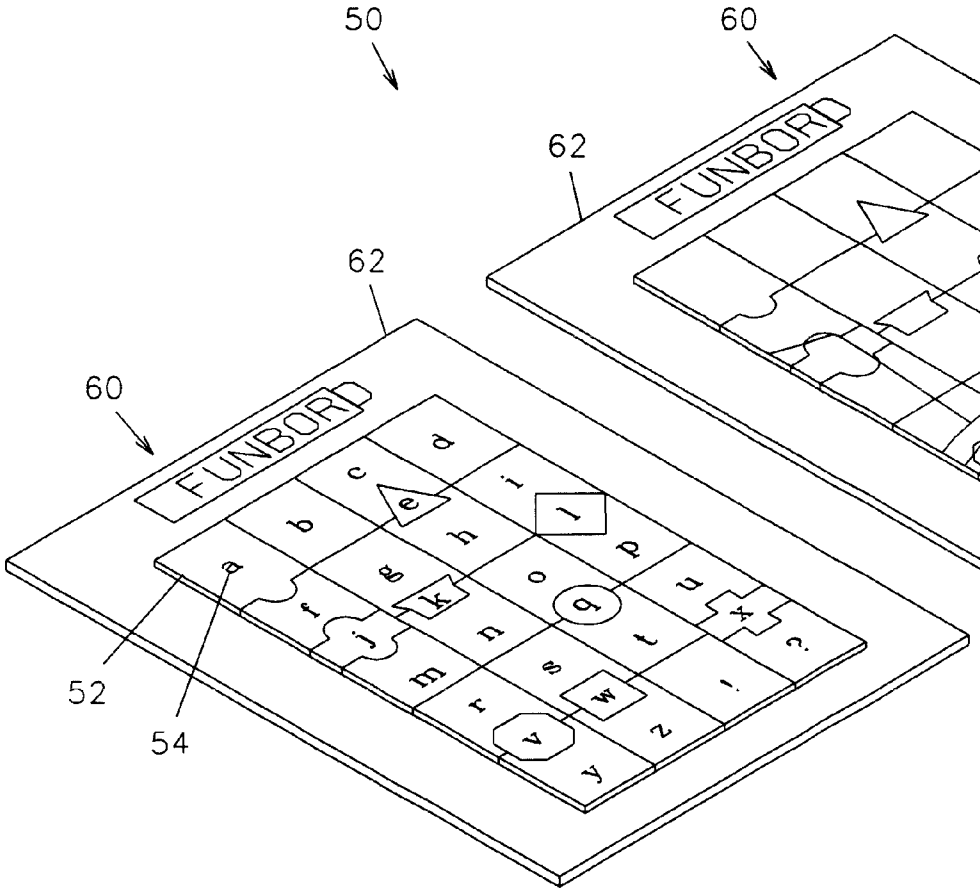
FIG. 6*a* is a perspective view of another alternative embodiment of the invention such that respective first sides of said cards are visible.
Figure 7A:
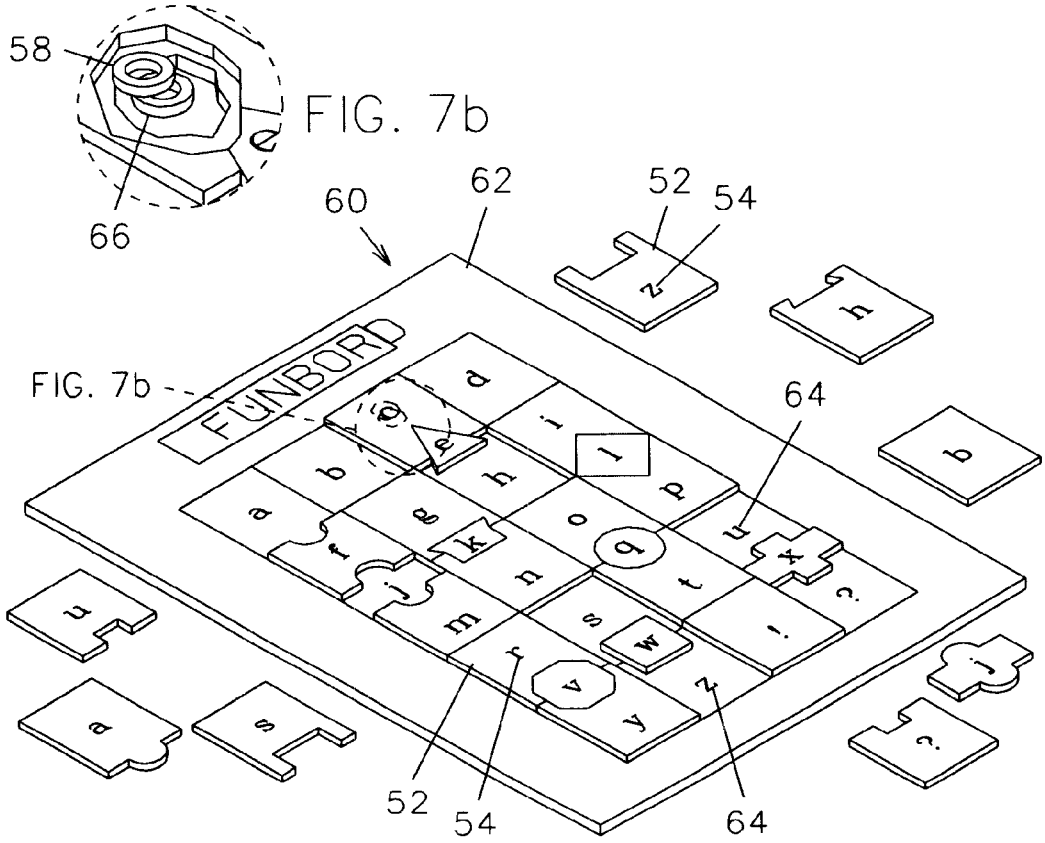
FIG. 7*a* is a perspective view on an enlarged scale of the game board as in FIG. 6*a* having some of the cards removed.
Figure 8:
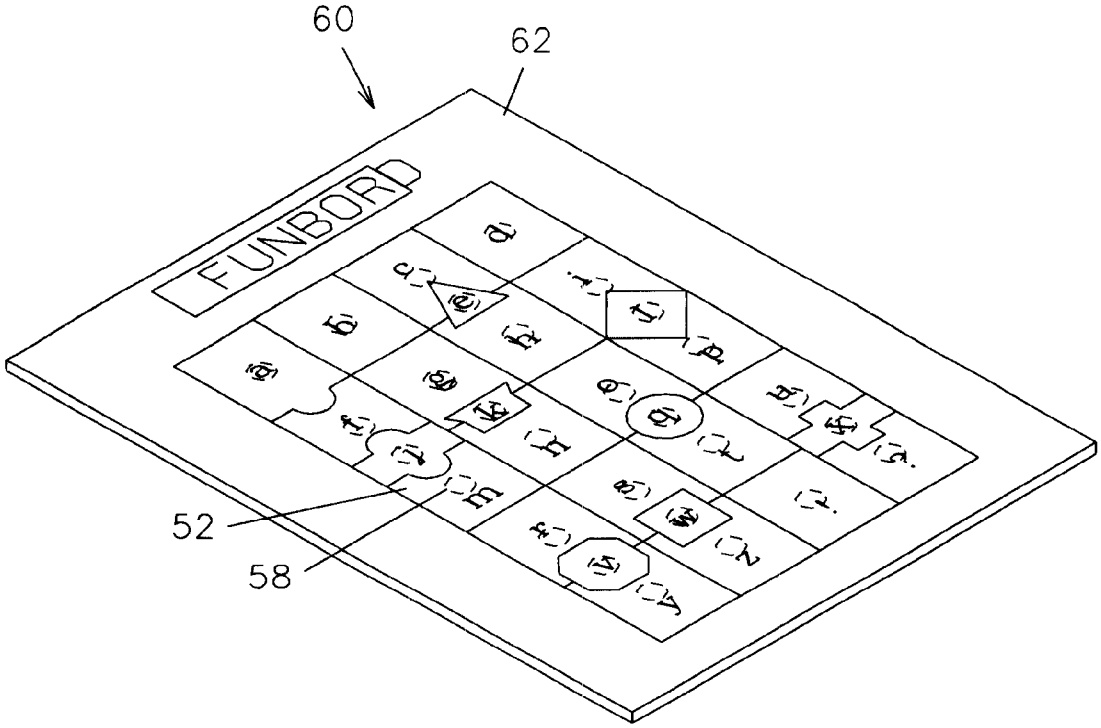
FIG. 8 is a perspective view on an enlarged scale of the game board as in FIG. 6*a* showing placement of the metallic elements in the cards as phantom lines.

Another alternative embodiment 50 of this invention is shown in FIGS. 6*a* through 8 and may be used according to the method described above. This embodiment 50 includes a plurality of cards 52 or tiles having irregularly shaped configurations. Each card 52 includes a first surface having a first set of alphanumeric indicia 54 imprinted thereon (FIG. 6*a*). Each card 52 further includes a second surface having pictorial indicia 56 imprinted thereon, such as scenery (FIG. *b*). A disk-like metallic element 58, such as a steel washer, is mounted within each card 52 and positioned generally in the center thereof (FIG. 8). This embodiment 50 further includes a game board 60 having first 62 and second surfaces, the second surface preferably being a mirror image of the first surface 62. The first surface 62 includes a second set of alphanumeric indicia 64 imprinted thereon in logical sequence, said first and second sets having matching indicia.

A plurality of disk-like magnets 66 are mounted within said game board 60 between the first 62 and second surfaces and spaced apart such that each magnet 66 corresponds to a respective metallic element 58 within a respective card 52. Further, each magnet 66 is positioned such that the magnetic attraction between a metallic element 58 and a corresponding magnet 66 causes the respective card 52 to be magnetically moved into a predetermined position upon the game board 60. The predetermined positions of the cards 52 are such that the cards will be held tightly together in a mating relationship once all the cards are positioned. This configuration also allows cards which are at first imprecisely positioned, such as by a child who lacks the dexterity to precisely position the card, to be magnetically drawn into a more precise position. For example, when a card is moved incrementally closer to the correct position, the card is eventually drawn into final position by the attraction of the metallic element to a corresponding magnet. In order to be automatically magnetically positioned, a card must initially be positioned such that the metallic element therein at least partially overlaps or is partially superimposed over a corresponding magnet in the game board. It is understood that individual magnets or metallic elements having a configuration other than a disk-like configuration would also be suitable. It should also be appreciated that a second set of cards having indicia different from that of a first set of cards may be used to form a different puzzle on the second side of the game board 60.

To further provide additional puzzles, a plurality of overlay sheets (not shown) may be included with the game board 62. Each sheet includes a magnetic strip or other magnetic means for removably holding the sheet upon the game board, the game board having a corresponding metallic element for engaging the magnetic means in the sheet. Each sheet further includes an outline of another puzzle arrangement. A deck of cards or puzzle pieces corresponding to a respective sheet is provided therewith. It is understood that the cards include metallic washers corresponding to the game board magnets as described previously. Therefore, multiple overlay sheets and corresponding cards may be provided with a game board 62 for economically providing multiple different puzzles.

To further simplify use by young children, the surfaces of the game board 60 may also include a set of markings corresponding to the peripheral shapes of the cards. The cards having alphanumeric markings would still be used with this modified game board since matching the shapes alone may not conclusively position the cards properly (i.e. some of the shapes may be identical).

Figure 9A:
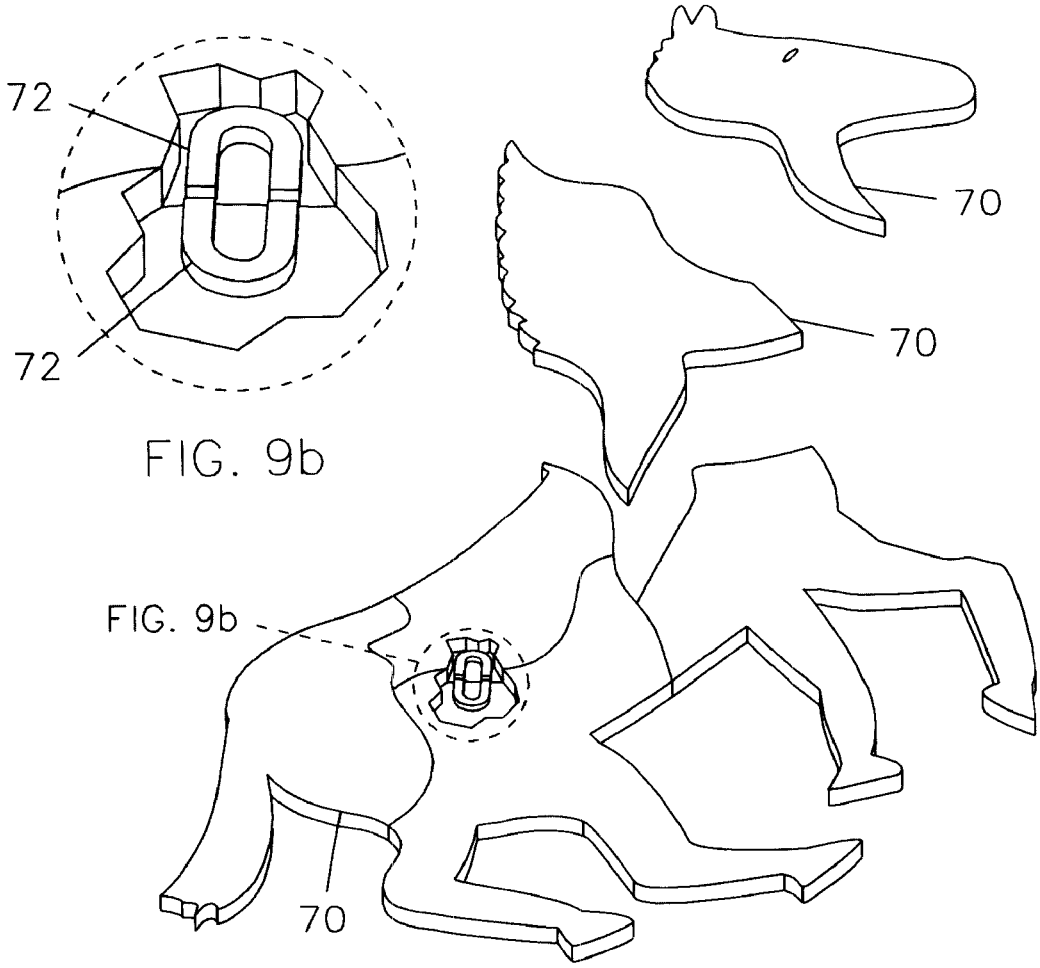
FIG. 9*a* is another alternative embodiment of the invention.

Still another embodiment of the invention is shown in FIGS. 9*a* and 9*b*. The tiles 70 include U-shaped magnets 72 mounted beneath the surface thereof and positioned adjacent peripheral edges. The magnets 72 are configured such that ends having opposite polarity will magnetically draw the tiles 70 together. This embodiment may be used with or without a game board surface.

Finally, it is understood that both sides of each card may include a coating suitable for use with dry erase markers such that other sets of indicia may be manipulated as desired by a user, for example, musical notes.

It is understood that while certain forms of this invention have been illustrated and described, it is not limited thereto except insofar as such limitations are included in the following claims and allowable functional equivalents thereof.

Having thus described the invention, what is claimed as new and desired to be secured by letters patent is as follows:

1. A board game, comprising:

a plurality of tiles having a first set of distinctive markings represented individually upon respective first surfaces thereof, each said tile including a disk-shaped metallic element positioned beneath a respective first surface, said plurality of tiles having a third set of distinctive markings represented individually upon respective second surfaces of said plurality of tiles;

a game board, comprising:

a second set of distinctive markings imprinted thereon, said first and second sets having matching markings; and a plurality of disk-shaped magnets positioned beneath a first surface of said game board and configured such that each of said tiles is magnetically drawn into a predetermined position upon said first surface of said game board when each said tile is positioned partially over a corresponding marking thereon.

2. A board game as in claim 1 wherein said tiles include irregularly shaped peripheral configurations.

3. A board game as in claim 1 wherein a diameter of each of said plurality of disk-shaped magnets is equal to a diameter of each of said metallic elements.

4. A board game as in claim 1 wherein said game board further includes a second surface opposite said first surface, said second surface of said game board being a mirror image of said first surface of said game board and said plurality of magnets being positioned between said first and second surfaces.

5. A board game as in claim 1 wherein said first and second sets of distinctive markings are alphanumeric indicia, said indicia of each respective set being different than any other indicia of said respective set.

6. A board game as in claim 1 wherein said disk magnets of said game board are adapted to magnetically attract said metallic elements of said tiles such that imprecisely positioned tiles are automatically positioned more precisely.

7. A board game as in claim 1 wherein said third set of distinctive markings includes portions of a scene.

8. A board game, comprising:

a plurality of cards, each card presenting a peripheral edge configuration and including a disk-shaped metallic element;

a first set of distinctive markings represented individually upon respective first sides of said plurality of cards;

a third set of distinctive markings represented individually upon respective second sides of said plurality of cards;

a game board, comprising:

a first surface having a plurality of markings imprinted thereon corresponding to said peripheral edge configurations of said plurality of cards;

a plurality of disk-shaped magnets positioned beneath said first surface such that each of said cards is magnetically drawn into a predetermined position upon said first surface when said card is positioned at least partially over a corresponding marking thereon; and a second set of distinctive markings imprinted on said first surface of said game board, said first and second sets having matching markings, whereby each of said cards is magnetically drawn to a predetermined position when partially superimposed over a corresponding marking on said first surface of said game board.

9. A board game as in claim 8 wherein said plurality of cards include irregularly shaped peripheral configurations.

10. A board game as in claim 8 wherein said game board includes a second surface opposite said first surface, said second surface being a mirror image of said first surface and said magnets being positioned between said first and second surfaces.

11. A board game as in claim 8 wherein said third set of distinctive markings includes portions of a scene.

12. A method of playing a card game for learning the elements of a given set, comprising the steps of:

providing a game board having a first set of distinctive markings imprinted in logical sequence thereon and a plurality of individual magnets positioned therein;

providing a second set of distinctive markings upon respective first sides of each card in a set of cards, each said card having a metallic element mounted beneath said respective first side and adapted to be magnetically attracted to a respective magnet in said game board, each said card in said set of cards including a portion of a scene imprinted on a second side of said card;

selecting a single card from said set of cards;

positioning said selected card on said game board such that the distinctive marking on said selected card is at least partially superimposed over a corresponding marking imprinted on said game board, whereby said selected card is moved to a predetermined position by the magnetic attraction between a respective magnet and metallic element if said selected card was at first imprecisely positioned;

repeating the steps of selecting and positioning until all of said cards have been positioned on said game board; and moving each said card from a position in which said first side is visible to a position in which said second side is visible whereby to display said scene.

13. A method as in claim 12 wherein said game board comprises first and second surfaces, said individual magnets being positioned between said first and second surfaces and configured such that said selected card is magnetically drawn to a predetermined position when said selected card is at least partially superimposed over a corresponding marking imprinted on said first or second surface.

14. A method as in claim 12 further comprising the steps of:

awarding a predetermined number of points to a game player for correctly positioning each said card upon said game board; and declaring a game player to be the winner who has accumulated the most points when all cards eligible for game play have been positioned.

15. A method as in claim 12 wherein said first and second sets include matching markings and said respective markings are alphanumeric markings.

* * * * *